US007310914B1

(12) United States Patent
Moore

(10) Patent No.: US 7,310,914 B1
(45) Date of Patent: Dec. 25, 2007

(54) TRUSS BRACKET FOR SHIPPING CONTAINER CONSTRUCTION

(76) Inventor: Marshall Moore, 1910 Ola Ave., Tampa, FL (US) 33602

( * ) Notice: Subject to any disclaimer, the term of this patent is extended or adjusted under 35 U.S.C. 154(b) by 494 days.

(21) Appl. No.: 10/907,316

(22) Filed: Mar. 29, 2005

(51) Int. Cl.
*E04B 7/04* (2006.01)
*E04B 1/38* (2006.01)

(52) U.S. Cl. ..... 52/92.2; 52/93.2; 52/289; 52/712; 52/643

(58) Field of Classification Search ..... 52/92.2, 52/93.2, 712, 289, 489.1, 241, 643, 696; 248/248; 428/577; 403/205, 287, 403
See application file for complete search history.

(56) References Cited

U.S. PATENT DOCUMENTS

| | | | | | |
|---|---|---|---|---|---|
| 666,918 | A | | 1/1901 | Butz | |
| 1,848,085 | A | | 3/1932 | Eisenschmidt | |
| 2,275,109 | A | * | 3/1942 | McGee | 52/733.3 |
| 3,256,030 | A | | 6/1966 | Banse | |
| 3,967,908 | A | * | 7/1976 | Snow et al. | 403/219 |
| 4,488,385 | A | | 12/1984 | Teasel et al. | |
| 4,572,695 | A | | 2/1986 | Gilb | |
| 4,669,235 | A | | 6/1987 | Reinen | |
| 4,672,785 | A | * | 6/1987 | Salvo | 52/241 |
| 4,897,979 | A | | 2/1990 | Colonias | |
| 4,932,173 | A | | 6/1990 | Commins | |
| 4,965,980 | A | * | 10/1990 | Leavens | 52/712 |
| 4,976,085 | A | | 12/1990 | Krueger | |
| 5,082,226 | A | | 1/1992 | Mahan | |
| 5,274,973 | A | * | 1/1994 | Liang | 52/243 |
| 5,313,752 | A | * | 5/1994 | Hatzinikolas | 52/243 |
| 5,437,132 | A | | 8/1995 | Meyers | |
| 5,487,343 | A | | 1/1996 | Phillips | |
| 5,870,874 | A | * | 2/1999 | Brothers | 52/696 |
| 6,254,306 | B1 | | 7/2001 | Williams | |
| 6,354,056 | B1 | | 3/2002 | Korzen | |
| 6,446,409 | B1 | | 9/2002 | Emerson | |
| 6,672,014 | B1 | * | 1/2004 | Jones | 52/92.2 |
| D492,889 | S | | 7/2004 | Craine | |
| 2002/0124483 | A1 | | 9/2002 | Rosas | |
| 2004/0074200 | A1 | * | 4/2004 | Attalla | 52/731.1 |
| 2004/0154257 | A1 | | 8/2004 | Kawai et al. | |
| 2004/0237443 | A1 | | 12/2004 | Haley et al. | |
| 2007/0144106 | A1 | * | 6/2007 | Kirk et al. | 52/712 |

FOREIGN PATENT DOCUMENTS

| | | |
|---|---|---|
| GB | 2 026 644 A | 2/1980 |

* cited by examiner

*Primary Examiner*—Robert Canfield
(74) *Attorney, Agent, or Firm*—Ronald E. Smith; Smith & Hopen, P.A.

(57) ABSTRACT

A truss bracket for connecting a roof to a shipping container includes an initially flat rectangular sheet of material in which is formed a longitudinally extending fold line that divides the sheet of material into a first part and a second part that are disposed at a predetermined angle relative to one another when a fold is formed in the fold line. The first part is adapted to be secured to a vertical wall of a shipping container and the second part is adapted to be engaged to a roof. A plurality of flanges are stamped from the second part and are folded out at a ninety degree angle relative to the plane of the second part to enable connection of the second part to the roof. A house is made by joining plural shipping containers together and securing a roof to the shipping container by using the truss bracket.

6 Claims, 8 Drawing Sheets

TRUSS BRACKET FOR SHIPPING CONTAINER CONSTRUCTION

FIELD OF THE INVENTION

This invention relates, generally, to construction methods. More particularly, it relates to a method that uses shipping containers in housing construction.

DESCRIPTION OF THE PRIOR ART

Shipping containers are in widespread use on ocean-going vessels, having replaced bulk-shipping methods. They allow a ship to carry many varieties of goods without mixing them together. They provide many other advantages as well.

Shipping containers are made of steel and therefore have a high level of structural integrity. However, when their useful lifetime is over, they are difficult to re-cycle. They are much too large to drop off at a re-cycling center, and it is expensive to cut them down to a size where they can be re-cycled. As a result, they are usually just stacked and left to rust.

There is a need, therefore, for a way to re-use or recycle old shipping containers that does not require them to be dismantled. Moreover, it would be advantageous if the structural integrity of a shipping container could be put to use when the container is re-used or recycled.

However, in view of the prior art taken as a whole at the time the present invention was made, it was not obvious to those of ordinary skill how the identified needs could be fulfilled.

SUMMARY OF THE INVENTION

The long-standing but heretofore unfulfilled need for a bracket that facilitates the construction of buildings that incorporate shipping containers is now met by a new, useful, and non-obvious invention. The novel bracket is adapted to interconnect a vertical wall of a shipping container to a roof construction.

The novel bracket is formed from a flat rectangular sheet of material having a longitudinally extending fold line formed therein that divides the sheet of material into a first part and a second part that are disposed at a predetermined angle relative to one another when a fold is formed in the fold line. The first part is adapted to be secured to a vertical wall of a shipping container and the second part is adapted to be engaged to a roof. A plurality of openings is formed in the first part, and each opening is adapted to receive an interconnecting means that joins the first part to the vertical wall of the shipping container. The openings are preferably equidistantly spaced from one another.

A plurality of square "C"-shaped cuts are formed in the second part and a folding line is associated with an uncut end of each of the square "C"-shaped cuts. Each of the "C"-shaped cuts is adapted to be folded about ninety degrees about a folding line associated with it, thereby creating a medial flange, each of which is adapted to be engaged to a roof construction.

A first end flange extends from a first end of the second part, and a second end flange extends from a second end of the second part. The first and second end flanges are formed integrally with the second part and each has a width dimension and a length dimension substantially equal to that of each of the medial flanges. Each of the end flanges are adapted to be folded about ninety degrees about a folding line associated with it and are further adapted to be engaged to a roof construction when folded about its associated folding line.

A plurality of openings is formed in each of the medial flanges, each opening being adapted to receive an interconnecting means that joins each medial flange to a preselected part of the roof construction.

A plurality of openings is also formed in each of the end flanges, each of which is adapted to receive an interconnecting means that joins each end flange to a preselected part of the roof construction.

Another plurality of openings is formed in the second part in intermediate relation to the medial flanges. Each opening is adapted to receive an interconnecting means that joins the second part to a preselected part of the roof construction.

The primary advantage of the novel bracket is that a plurality of such brackets have utility in securing a roof assembly to a shipping container so that one or more shipping containers may be joined together to build a house or a non-residential building.

Another important advantage is that the resulting building structure is able to withstand very high winds so that the occupants of such a structure are protected during severe storms.

Still another advantage is that the cost per square foot of a building that incorporates shipping containers and the novel brackets is less than the cost per square foot of a conventional building.

These and other advantages will become apparent as this disclosure proceeds. The invention includes the features of construction, arrangement of parts, and combination of elements set forth herein, and the scope of the invention is set forth in the claims appended hereto.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
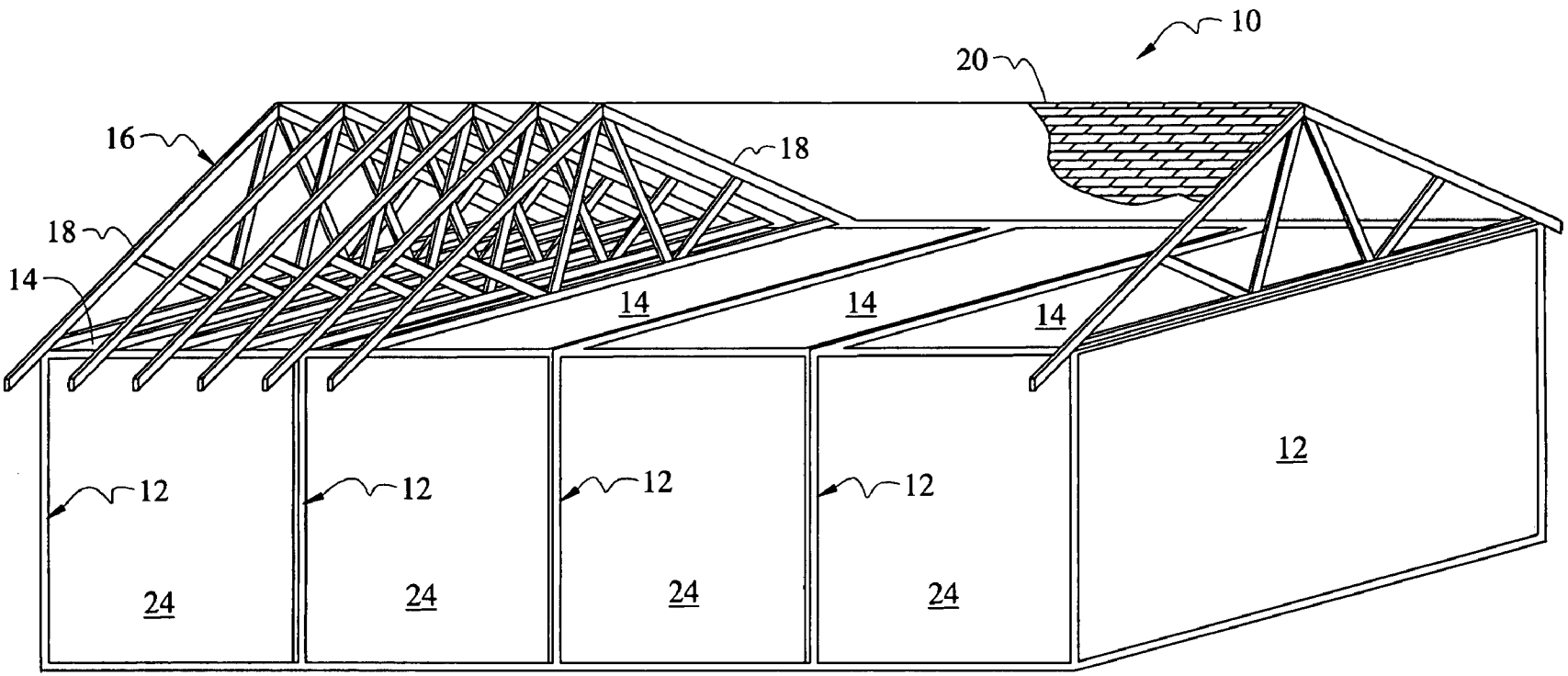
FIG. 1 is a perspective view of a building that includes shipping containers as an integral part thereof and a conventional roof.

Referring now to FIG. 1, it will there be seen that a house or other occupied or unoccupied building 10 is constructed in part by welding together a plurality of shipping containers, collectively denoted 12, in side-by-side relation to one another. In this particular example, four containers are used in a single story design but differing numbers of containers may be used and the designs may include multiple stories.

Each container 12 includes its own top wall 14 so no roof construction is needed for house 10. However, to increase the aesthetic appeal of the house, and to disguise the fact that it is made from containers, it is advantageous to add a conventional rood construction thereto. The roof construction is denoted 16 as a whole and includes a plurality of trusses, collectively denoted 18, ridge 20, and other conventional parts that are not numbered because they are well known and are not a part of the invention, per se.

Figure 2:
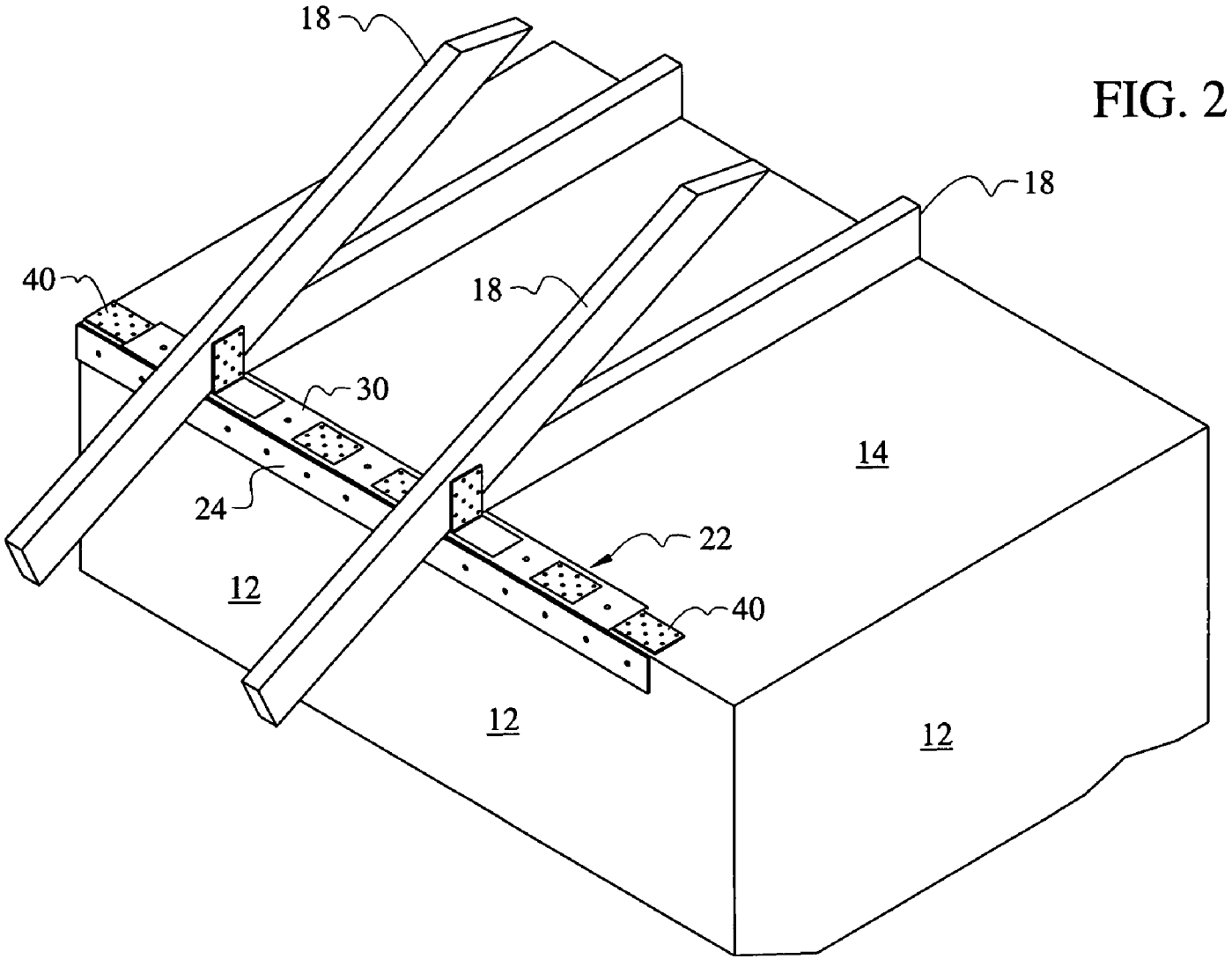
FIG. 2 is a perspective view like that of FIG. 1, providing a more detailed view of the connection between the shipping containers and the roof construction.

The novel bracket of this invention is denoted 22 in FIG. 2. A plurality of brackets 22 is used to interconnect vertical wall 22 of a shipping container 12 to a roof truss 18, thereby securing the roof to said shipping container. Novel brackets 22 are designed to defeat high winds but, again, if roof 16 is destroyed by high winds, the occupants of the building are still protected by container top wall 14 and the remaining parts of said shipping container.

Figure 3:
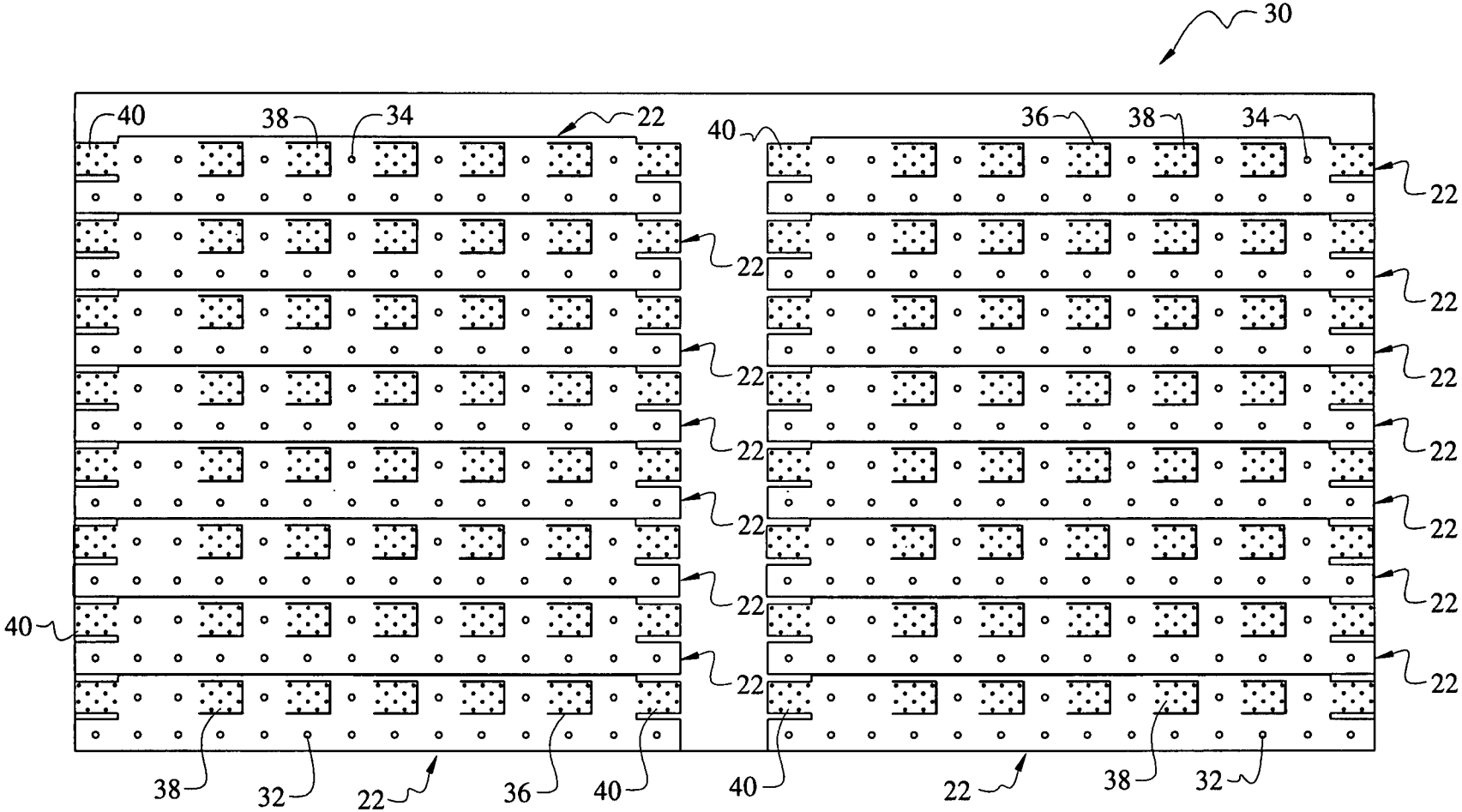
FIG. 3 is a top plan view of a sheet of metal that has been stamped to provide a plurality of brackets.

Referring now to FIG. 3, it will there be seen that the starting material for the invention is denoted as a whole by the reference numeral 30. Sheet 30 is metallic and in a preferred embodiment is ten feet long and five feet wide. That size enables the stamping from said sheet of sixteen flat brackets, collectively denoted 22 as aforesaid.

Figure 4:
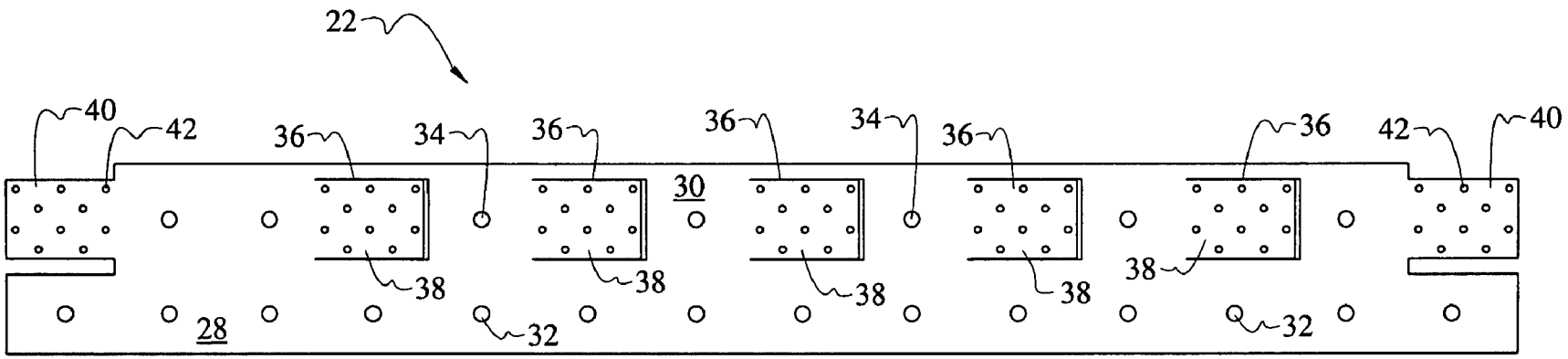
FIG. 4 is a top plan view of a bracket after separation from the sheet of metal depicted in FIG. 3.

A single bracket 22 is depicted in FIG. 4 in its flat configuration, i.e., as stamped from said sheet 30.

Figure 5:
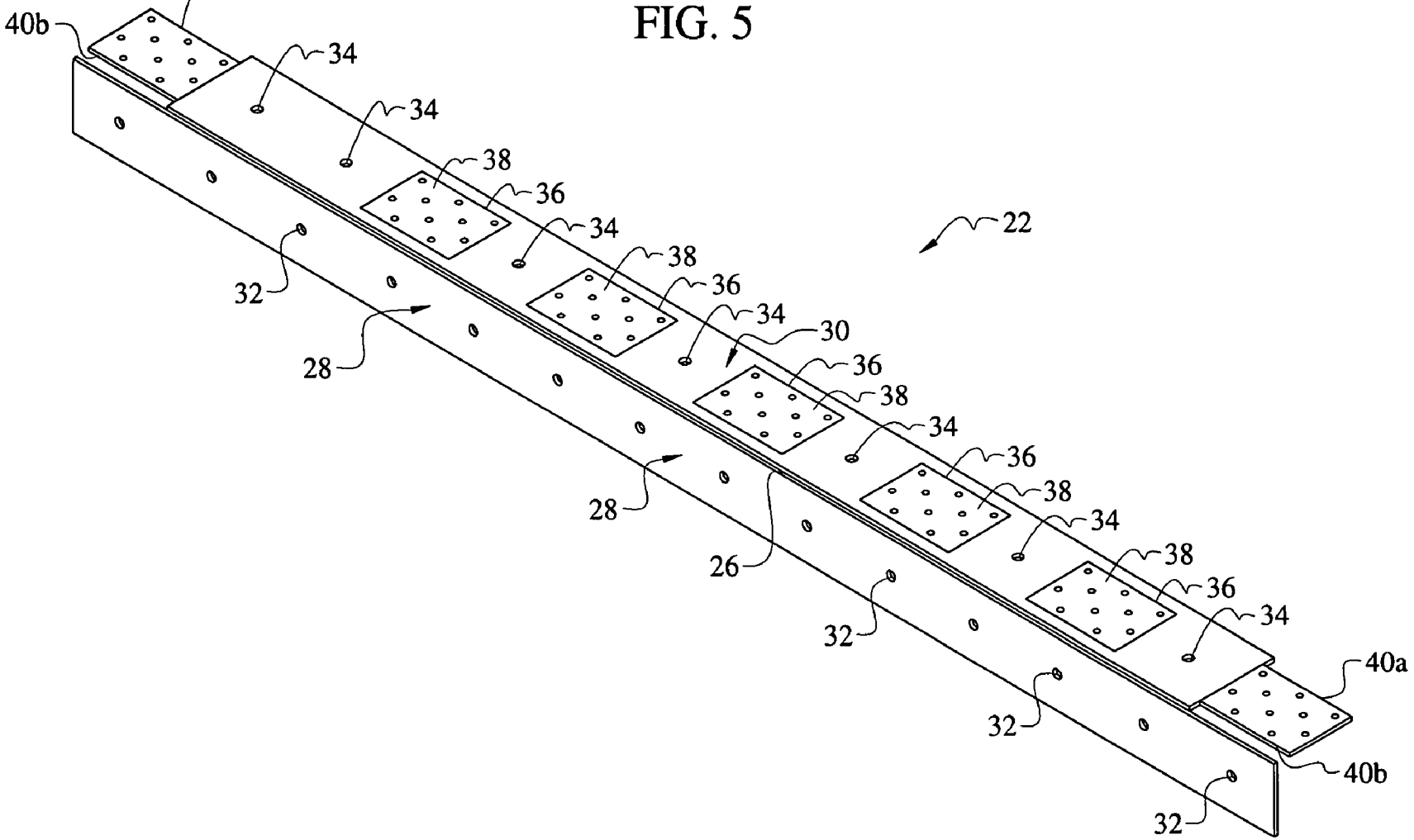
FIG. 5 is a perspective view depicting a bracket after it has been bent along a longitudinal folding line.

Bracket 22 is depicted in FIG. 5 in its folded configuration. It has been folded at a preselected angle along longitudinally extending folding line 26.

As folded, part 28 thereof is secured to an upstanding wall of a shipping container, and part 30 thereof is adapted to be secured to a roof assembly that is mounted in surmounting relation to the top wall or ceiling of a shipping container.

A plurality of apertures, collectively denoted 32, is formed in part 26 of bracket 20. A spot weld is placed in each of these apertures to secure part 28 to vertical wall 24 of a shipping container 12.

The fold angle between parts 28 and 30 is changed to match the pitch of roof assembly 16 that overlies ceiling wall 14 of the shipping container. Thus, the angle would be ninety degrees (90°) for a flat roof having no pitch, one hundred degrees (100°) for a roof having a ten percent (10%) pitch, and so on. Folding line 26 thus provides a living hinge so that parts 28 and 30 may be oriented at any predetermined angle relative to one another.

The function of novel brackets 22 is to prevent roof-house separation. The large number of spot welds for each bracket 22 (in this example, it will be observed that there are fourteen (14) apertures 32 and thus fourteen (14) spot welds per vertical bracket part 28. This ensures that said part 26 will not separate from vertical wall 24 of shipping container 12.

Similarly, a plurality of apertures, collectively denoted 34, is also formed in part 30 of bracket 22, and a spot weld is formed in each of said apertures to unite together said part 30 and its associated truss member 18.

Part 30 of each bracket 22 is also stamped as at 36 to form a plurality of square "U"-shaped flaps, collectively denoted 38, that can be bent at a ninety degree (90°) angle to the plane of wall 30 from which they are stamped. Flaps 38 are referred to as medial flaps. End flaps, denoted 40, are formed by stamping as well but the material between a first longitudinal cut 40*a* and the edge of plate 30 is removed as is the material between a second longitudinal cut 40*b* and the edge of plate 30.

A plurality of openings, collectively denoted 42, is formed in each medial flap 38 and in each end flap 40.

Figure 6:
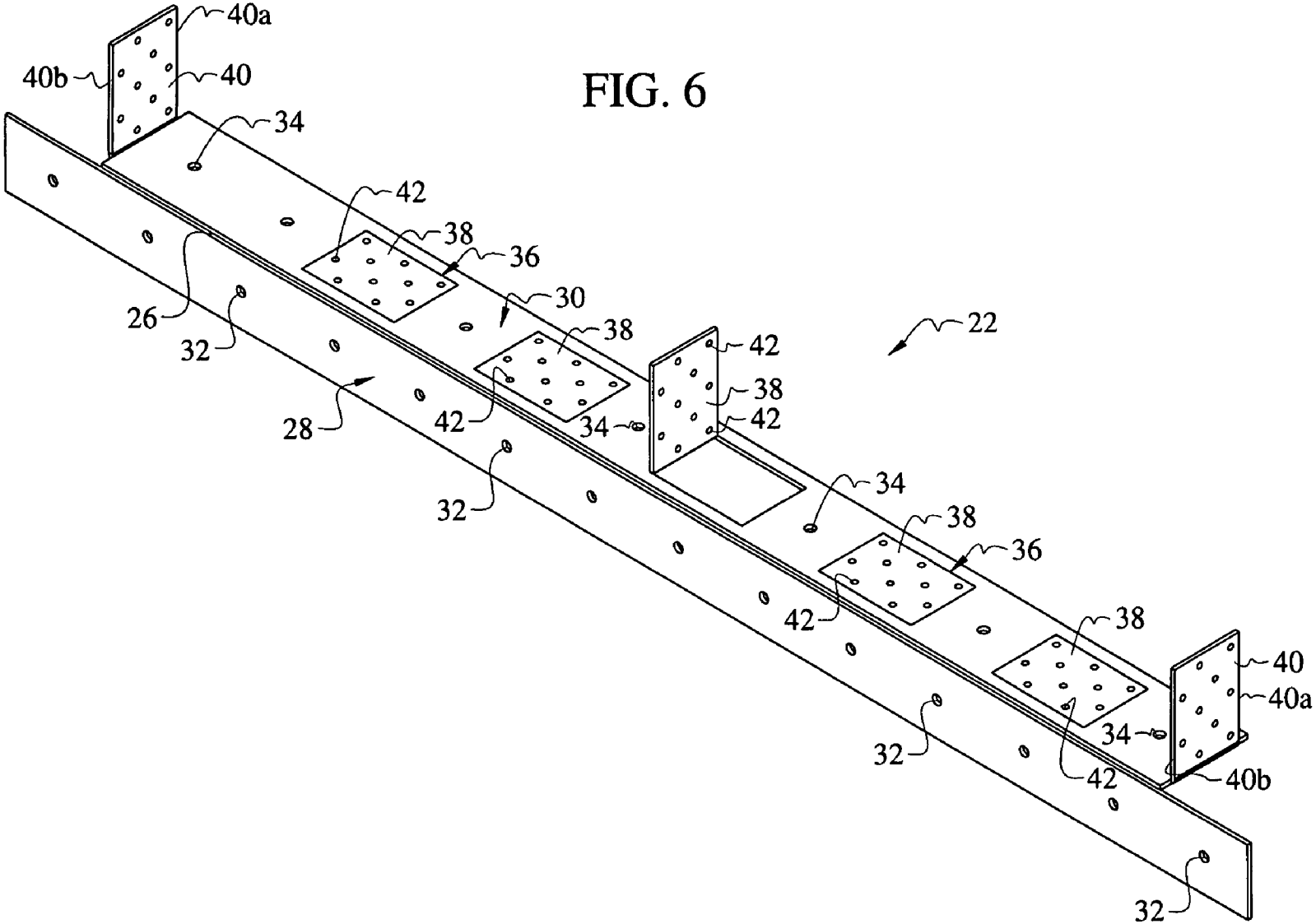
FIG. 6 is a perspective view depicting a first configuration of the bracket of FIG. 5.

In this particular example, there are five (5) "U"-shaped stamped sections 36. In the embodiment of FIG. 6, the third medial flap 38 and both end flaps 40, 40 are bent at a ninety degree (90°) angle to the plane of part 30. A suitable fastener extends through each opening 42 to secure each flap 38 to its associated roof truss 18. Suitable fasteners includes such fastening means as nails, screws, staples and the like.

Figure 7:
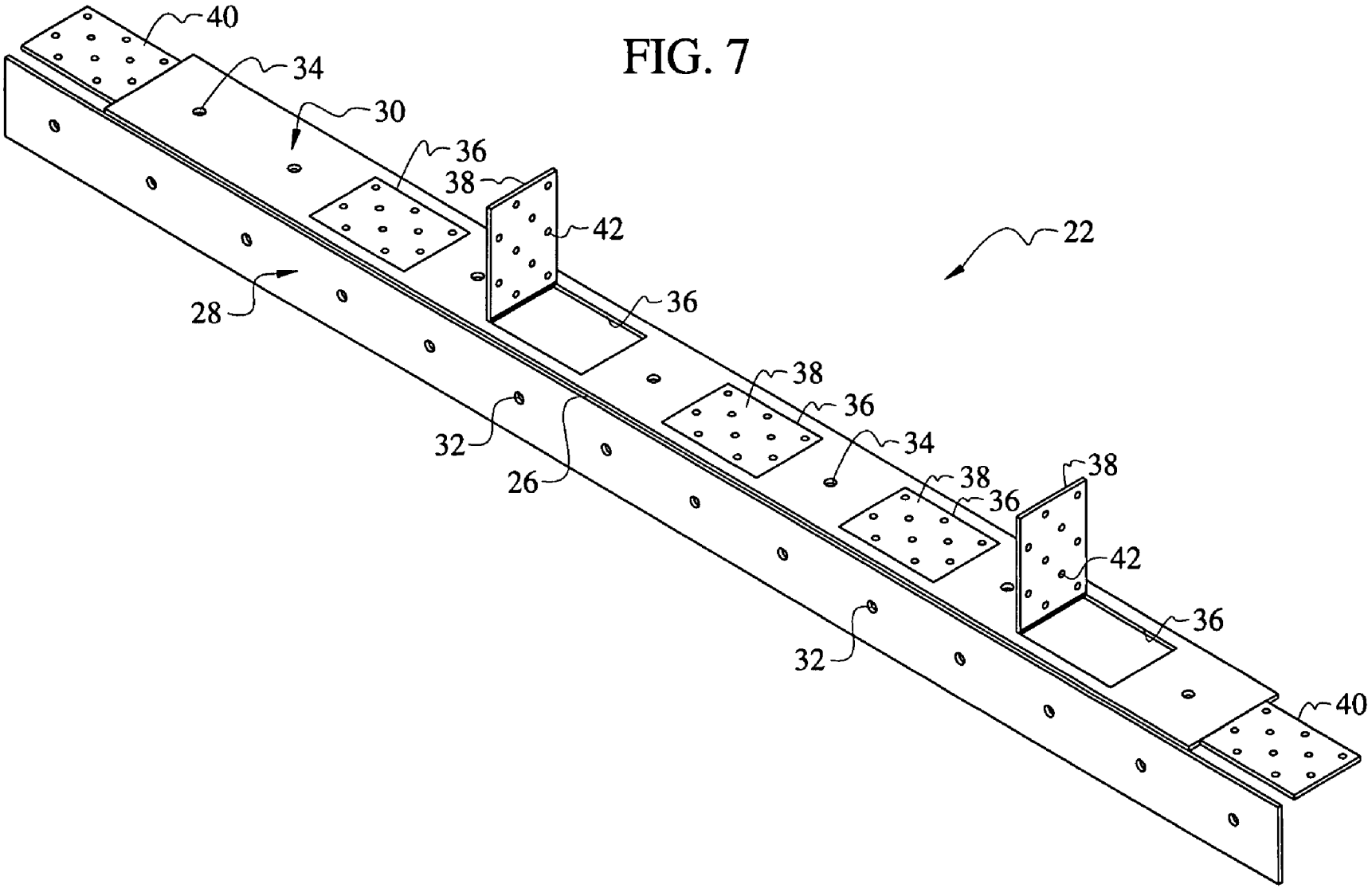
FIG. 7 is a perspective view depicting a second configuration of the bracket of FIG. 5.

In the example of FIG. 7, second and fifth medial flaps 38 are folded at a ninety degree (90°) angle relative to second part 28 to facilitate their connection to a roof truss. End flaps 40 remain in their unfolded configuration.

Figure 8:
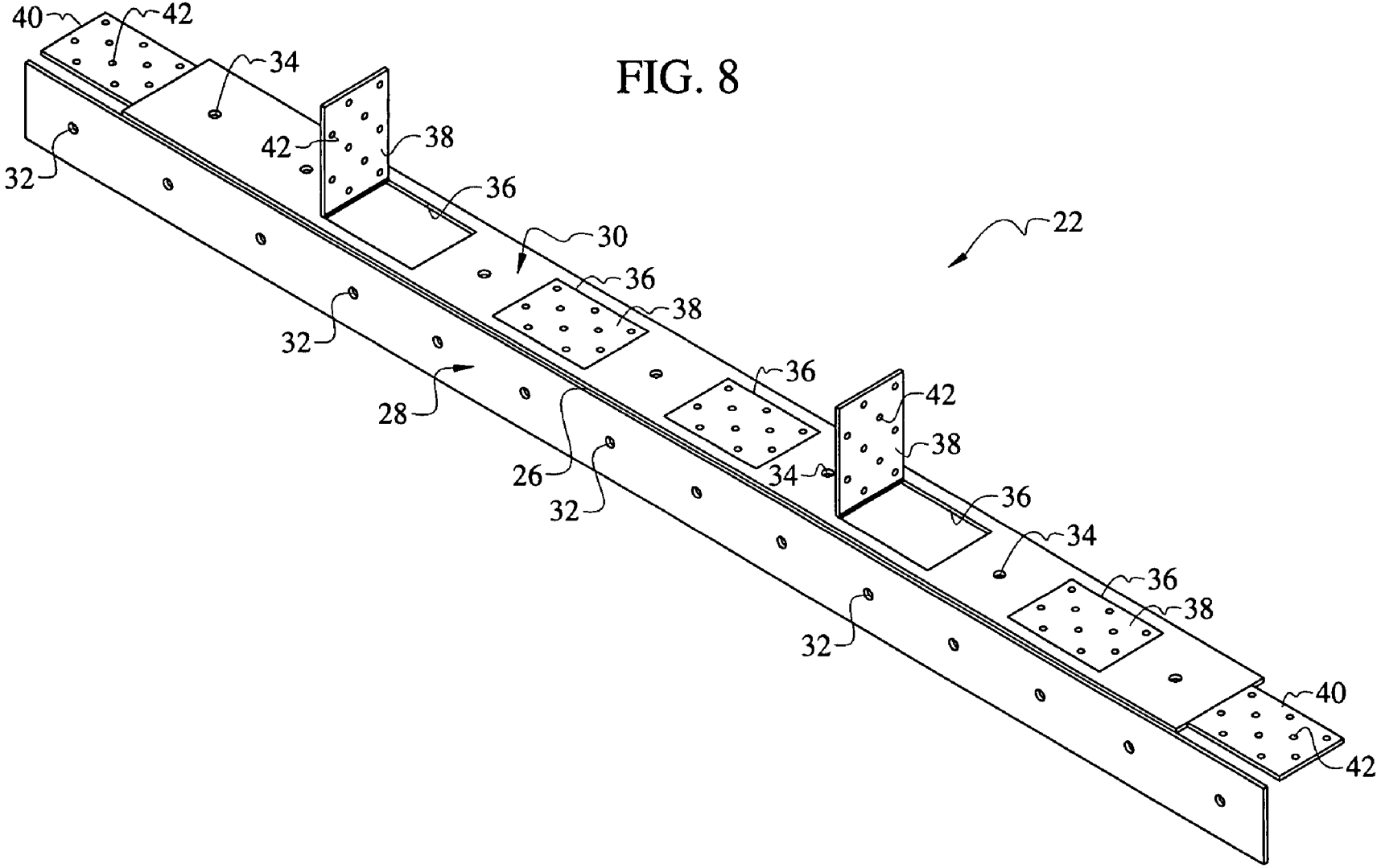
FIG. 8 is a perspective view depicting a third configuration of the bracket of FIG. 5.

In the example of FIG. 8, first and fourth medial flaps 38 are folded at a ninety degree (90°) angle relative to second part 30 to facilitate their connection to a roof truss. End flaps 40 remain in their unfolded configuration.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A bracket for connecting a roof to a shipping container, comprising:

a flat rectangular sheet of material; a longitudinally extending fold line formed in said sheet of material; said longitudinally extending fold line dividing said sheet of material into a first part and a second part; said first part and said second part being disposed at a predetermined angle relative to one another when a fold is formed in said fold line; said first part adapted to be secured to a vertical wall of a shipping container; said second part adapted to be engaged to a roof; a plurality of openings formed in said first part; each opening of said plurality of openings formed in said first part adapted to receive an interconnecting means that joins said first part to said vertical wall of said shipping container; a plurality of square "C"-shaped cuts formed in said second part; a folding line associated with an uncut end of each of said square "C"-shaped cuts; each of said "C" shaped cuts adapted to be folded at its respective folding line; a medial flange formed when each of said square "C"-shaped cuts is folded about ninety degrees relative to its associated folding line; each of said medial flanges adapted to be engaged to a roof construction; whereby said bracket is adapted to interconnect said vertical wall of said shipping container and said roof construction.

2. The bracket of claim 1, further comprising: a first end flange extending from a first end of said second part; a second end flange extending from a second end of said second part; said first and second end flanges formed integrally with said second part; said first and second flanges each having a width dimension and a length dimension substantially equal to a width dimension and a length dimension of each of said medial flanges; each of said end flanges adapted to be folded about a folding line associated with it; each of said end flanges adapted to be engaged to a roof construction when folded about its associated folding line.

3. The bracket of claim 2, further comprising: a plurality of openings formed in each of said medial flanges; each opening of said plurality of openings formed in said medial flanges adapted to receive an interconnecting means that joins each medial flange to a preselected part of said roof construction.

4. The bracket of claim 3, further comprising: a plurality of openings formed in each of said end flanges; each opening of said plurality of openings formed in said end flanges adapted to receive an interconnecting means that joins each end flange to a preselected part of said roof construction.

5. The bracket of claim 4, further comprising: a plurality of openings formed in said second part in intermediate relation to said medial flanges; each opening of said plurality of openings formed in said second part adapted to receive an interconnecting means that joins said second part to a preselected part of said roof construction.

6. The bracket of claim 5, further comprising: said fold line providing a living hinge that enables said first and second parts to be oriented at a plurality of differing angles relative to one another so that said bracket is used with roofs of differing slopes.

* * * * *